United States Patent [19]

Kennedy

[11] 4,192,064

[45] Mar. 11, 1980

[54] HIGH STRENGTH EXTENDED LEAKAGE PATH CERAMIC TUBE WALL FOR IMAGE INTENSIFIER AND METHOD OF MANUFACTURE

[75] Inventor: Andrew J. Kennedy, Lorton, Va.

[73] Assignee: The United States of America as represented by the Secretary of the Army, Washington, D.C.

[21] Appl. No.: 922,016

[22] Filed: Jul. 5, 1978

[51] Int. Cl.[2] ..... H01B 19/00

[52] U.S. Cl. ..... 29/631; 264/23; 264/86; 264/62; 264/129

[58] Field of Search ..... 264/62, 61, 227, 63, 264/86, 129, 219, 23, 220, 65, 66, 71; 65/23; 29/25.11, 631

[56] References Cited

U.S. PATENT DOCUMENTS

| | | | |
|---|---|---|---|
| 1,628,417 | 5/1927 | Miller | 65/23 X |
| 2,182,185 | 12/1939 | Trump | 313/444 X |
| 2,390,354 | 12/1945 | Clapp | 264/63 |
| 2,515,017 | 7/1950 | Nicholson | 264/227 X |
| 3,074,143 | 1/1963 | Smith | 264/62 |
| 3,234,308 | 2/1966 | Herrmann | 264/63 |
| 3,355,614 | 11/1967 | Geiger et al. | 313/360 |
| 3,988,405 | 10/1976 | Smith et al. | 264/61 X |

FOREIGN PATENT DOCUMENTS

| | | | |
|---|---|---|---|
| 1201034 | 9/1965 | Fed. Rep. of Germany | 264/220 |
| 688312 | 3/1953 | United Kingdom | 264/33 |
| 953705 | 3/1964 | United Kingdom | 29/631 |

*Primary Examiner*—Francis S. Husar
*Assistant Examiner*—C. J. Arbes
*Attorney, Agent, or Firm*—Nathan Edelberg; Robert P. Gibson; Max L. Harwell

[57] ABSTRACT

A high strength and serrated edge extended leakage path ceramic tube wall for high voltage tube device, such as a proximity focused image intensifier, and method of making same. The ceramic may be comprised of a ceramic particle slurry made of high density alumina in a glass binder wherein the slurry is ultrasonically compacted against ultrasmooth mold walls in the uncured state. The mold may be formed by using a highly polished preshaped, positive, made of a metal such as brass, and then removing the positive. The mold may be further processed by electrodepositing a metal, such as nickel or nickel alloys, onto the positive to produce an ultrasmooth surface. The mold may be made of a vinyl polymer type thermoplastic. The inside of the mold takes up the smooth surface characteristics of the positive that is, in turn, transferred to the uncured ceramic when sufficiently pressed and compacted by the ultrasonically compacting step. The uncured ceramic is then pre-baked at about 350° C. for some time to produce a green ceramic at which time the mold is removed from the green ceramic. The green ceramic may have milled sections produced therein. After the sections are milled, the green ceramic is fired in the temperature range of 1600°-1800° C for about 15 hours to cure.

7 Claims, 5 Drawing Figures

HIGH STRENGTH EXTENDED LEAKAGE PATH CERAMIC TUBE WALL FOR IMAGE INTENSIFIER AND METHOD OF MANUFACTURE

The invention described herein may be manufactured, used, and licensed by the U.S. Government for governmental purposes without the payment of any royalties thereon.

BACKGROUND OF THE INVENTION

The present invention is in the field of formed ceramic devices and the method of manufacturing same such that the ceramic devices may be used, for example, as a tube wall in an image intensifier as an extended leakage current path for high voltage application across narrow cathode-anode spaced (0.75mm–1.0mm) proximity focused image intensifier tube with increased high voltage stability due to runaway leakage current breakdown. The prior art cured ceramic tubes were either machined into some special form, or the green or uncured ceramics were molded into desired forms by pressing the green or uncured ceramic slurry against a mold. Both the machining method and the prior art molding method had the disadvantage of leaving surfaces on the ceramics that were rougher than were tolerable for use in the high electric field devices, such as in proximity focused image intensifier tubes. Prior art machining methods generally left the tube wall surfaces much rougher than possible to produce with ceramics having grain sizes on the order of 0.05 to 50 micrometers. This deficiency is corrected by the monomolecular surface smoothness of only 5 to 10 millimicrons of suitably fabricated plastic molds.

SUMMARY OF THE INVENTION

The present specifically configured ultrasmooth ceramic devices are produced in molds that may be made of a vinyl polymer type thermoplastic or similarly moldable plastics. The surface smoothness of these types of plastic materials is on the order of molecular dimensions of from 0.005 to 0.01 micrometers.

The mold into which the ceramic slurry is poured and the ceramic tube wall device produced therein are made by the method steps described herein below. The mold is preferably made of the vinyl polymer type thermoplastic. The uncured ceramic slurry is poured into the mold and it is compacted into all cavities of the mold under ultasonic agitation. In this manner the viscous ceramic slurry takes up the smooth surface characteristics of the plastic mold. The ceramic slurry and plastic mold are then pre-baked for some time to produce the green ceramic. The next step is to mill out a trough in one or both ends of the green ceramic. The green ceramic is then high temperature fired at from 1600° C. to 1800° C. for about 15 hours to produce a cured ceramic tube wall that has high dielectric and mechanical strength. The last step is that of metallizing both ends of the ceramic tube wall to make it suitable for brazing to a Kovar intermediary ring between the tube wall and the high voltage tube base. The milled out troughs, which may or may not be metallized in the metallization step, serve for example as an indium alloy reservoir for either hot or cold indium sealing the components of the image intensifier tube.

IN THE DRAWINGS

FIG. 1 is a flow chart in block diagram of the steps of the present method of producing ultrasmooth extended leakage path ceramic tube walls;

FIGS. 2A, 2B, and 2C show examples in part section of three different sized annular serrations along the wall of the ceramic tube wall; and FIG. 3 illustrates a cut-away section of the completed ceramic tube wall.

DETAILED DESCRIPTION OF THE INVENTION

Figure 1:
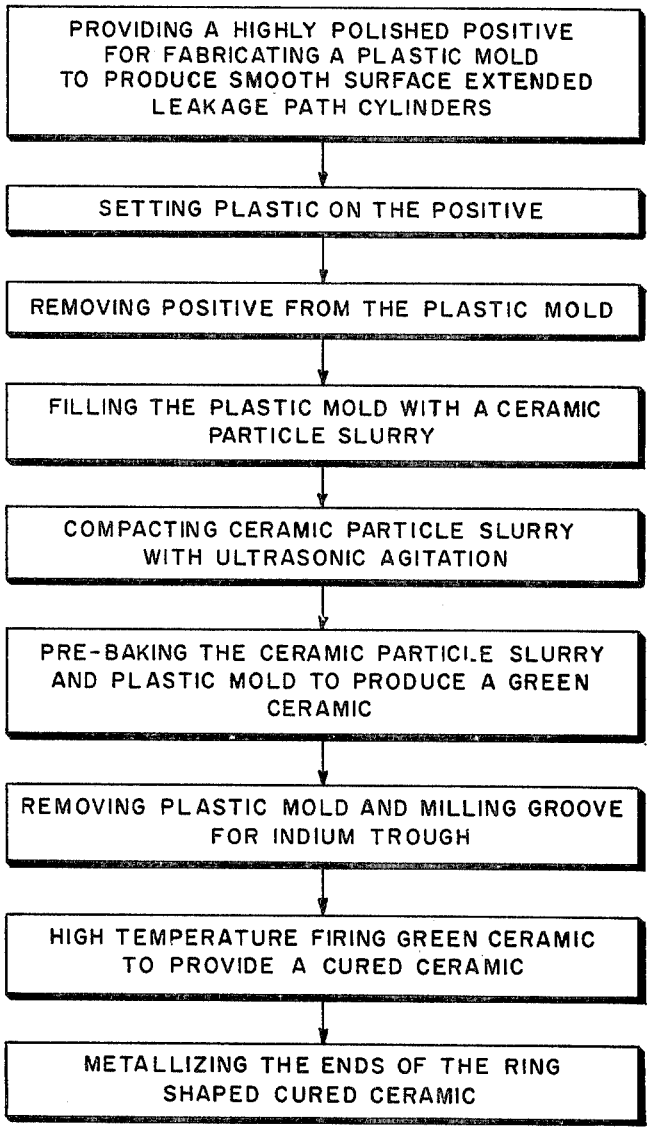

FIG. 1 illustrates in block diagram the steps involved in producing the present ultrasmooth surfaced extended leakage path ceramic tube wall for high voltage tube devices, such as for the increasingly smaller but high voltage present day proximity focused image intensifier tubes. A highly polished preshaped positive, such as for example brass or other easily machined metal, is used to fabricate a plastic mold of the desired exact size and shape of the finished ceramic tube wall. The plastic molds may be made of a vinyl polymer type thermoplastic. The surface smoothness of this type of plastic material is on the order of molecular dimensions of 0.005 to 0.01 micrometer. The configuration of the preshaped plastic is preferably ultrasmooth alternately concave and convex half circular transitions with possible inward extensions between the concave and convex half circles. These configurations are shown in half section in FIGS. 2A, 2B, and 2C and will be explained more fully herein below. The next step is setting the plastic on the positive. The mold is then removed from over the positive by slipping the resilent plastic mold off the positive.

The next step of the method is filling the plastic mold with a ceramic particle slurry. The ceramic particle slurry is preferably a vacuum tube envelope quality alumina ($Al_2O_3$) of 95% to 98% in a granular glass binder. The next step is compacting the ceramic particle slurry with ultrasonic agitation by mounting the plastic mold with the ceramic particle slurry therein on a platform, or other structure, and moving the platform by ultrasonic agitation. The ultrasonic agitation step is important to avoid the formation of voids of the ceramic particle slurry in the plastic mold so that the slurry may make intimate contact with all of the ultrasmooth walls of the plastic mold.

The ceramic particle slurry and the plastic mold are pre-baked at from 300° C. to 500° C. for a period of 4–5 hours to drive water out and make the ceramic solid to form a green ceramic tube wall. The green ceramic at this time is soft enough so that the ends may be machined.

Figure 3:
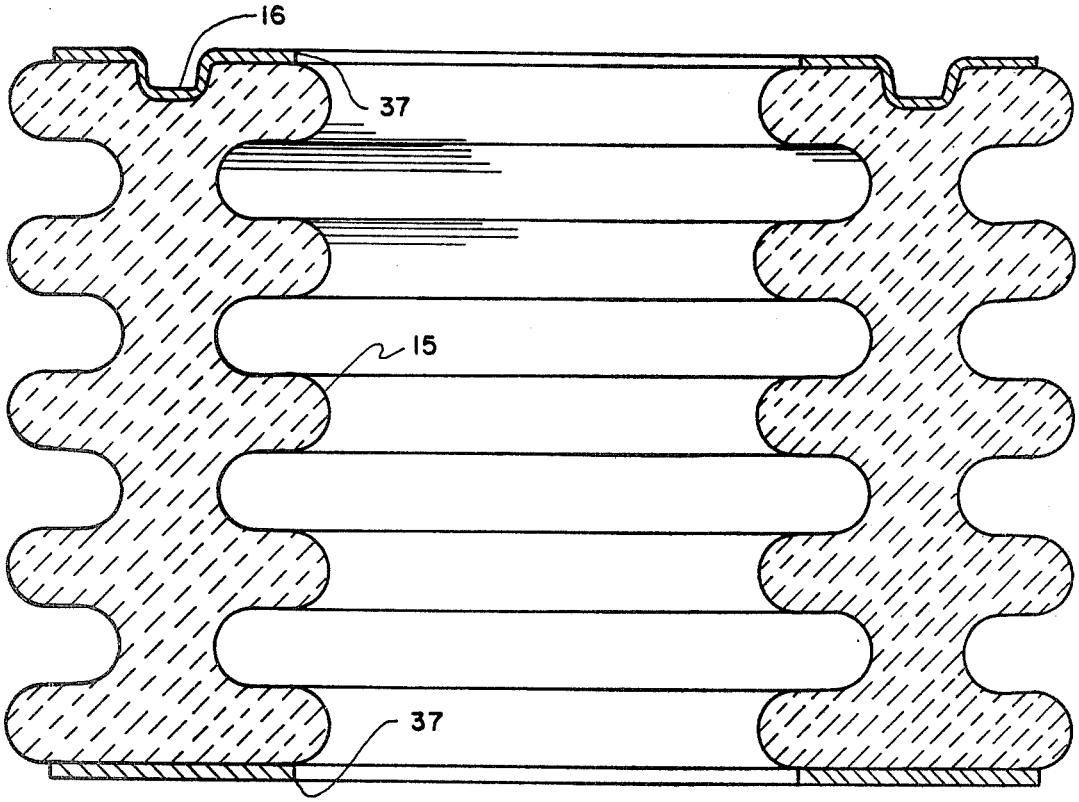

The plastic mold may be easily removed at this time since the plastic has lost its resiliency and may be peeled off the green ceramic tube wall. Troughs are milled in one or both ends of the green ceramic tube wall. The green ceramic tube wall goes through a high temperature firing step to provide a cured ceramic tube wall. The high temperature firing is at between 1600° C. to 1800° C. for 15 hours. The ends of the cured ceramic tube wall are metallized to make it suitable for brazing to a Kovar intermediary ring to connect with the high voltage tube. The cured ceramic tube wall 15 is shown in section in FIG. 3. Trough 16 is shown along with the metallized layer 37. This metallizing step is comprised of first spraying molybdenum on the ends of 15 at a temperature of 1700° C. wherein the molybdenum forms a strong bond with the ceramic. A layer, and possibly a nickel overlay layer on the copper, are then deposited on the molybdenum. The metallization layer may also go inside the milled trough.

Figure 2A:
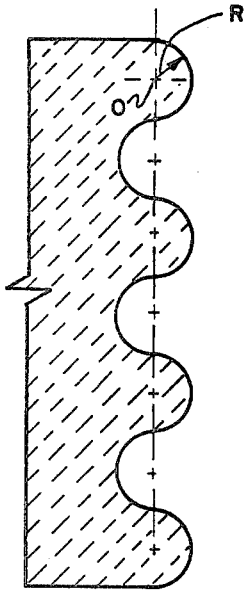
Figure 2B:
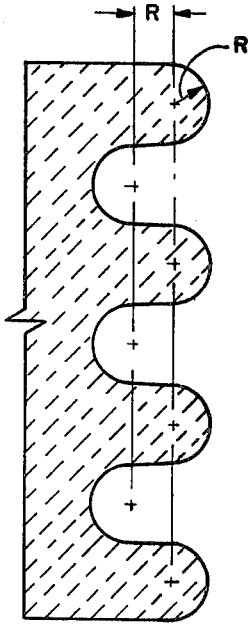
Figure 2C:
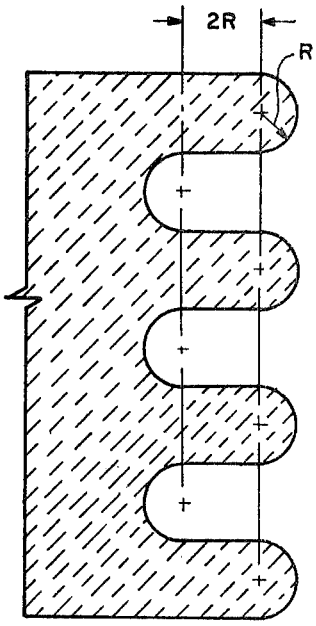

The preferred configuration of the annular serrations around both the inside and outside of the ceramic tube walls are alternately concave and convex circular sections. A typical radius of curvature, represented as R, for the circular sections is ¼ to ½ millimeter. FIG. 2A represents the embodiment in which the radius R is swept out from the center of the circle, represented as O, such that as the convex circle ends at one half circle the concave circle begins for a half circle and so on throughout a typical seven sweeps. In FIG. 2B, there are inward extensions of the equivalent of one radius R. FIG. 3C shows inward extensions of the equivalent of two radii, or 2R. Breakdown voltage tests were run on prior art 300 mil and 250 mil width smooth surfaced ceramic tube walls. The breakdown voltage causing an abrupt increase in the leakage current had been respectively about 11 KeV and 9 KeV. Estimates were made of the increased breakdown voltage for 300 mil and 250 mil spacings of electrodes 37, using the annular serrations as shown in FIGS. 2A, 2B, and 2C in the ceramic tube wall and assuming that the magnitude of the leakage current scales linearly with the increased tube wall lengths. As an example, the configuration of FIG. 2A has an increased tube wall length by a factor of 1.57 from a straight walled ceramic tube as a result of the seven circular configurations defined by the formula $(7\pi/14)=1.57$, and the breakdown voltage due to excessive leakage current is now increased for 300 mil and 250 mil widths respectively to 17.3 KeV and 14.1 KeV.

While the principles of the invention have been described with reference to specific embodiments and particular modifications thereof, it will be apparent to one skilled in the art that various modifications can be made therein without departing from the inventive concept.

I claim:

1. A method of producing a smooth surfaced extended leakage path ceramic tube wall for a high voltage tube device, the steps comprising:

providing a highly polished preshaped positive for fabricating an ultrasmooth walled plastic mold having alternating convex and concave circular radius of curvatures of from ¼ to ½ millimeter radii along the wall thereof setting plastic on said preshaped positive to form an ultrasmooth walled plastic mold for making a smooth surfaced extended leakage path for said ceramic tube wall;

removing said preshaped positive from said plastic mold;

filling said plastic mold with a ceramic particle slurry of a vacuum tube envelope quality alumina of 95% to 98% in a granular glass binder;

compacting said ceramic particle slurry against the ultrasmooth plastic mold with ultrasonic agitation;

prebaking the combined said ceramic particle slurry and said ultrasmooth walled plastic mold to produce a ring-shaped green ceramic tube wall;

removing said plastic mold from said ring-shaped green ceramic tube wall;

making a trough in at least one end of said ring-shaped green ceramic tube wall;

high temperature firing said green ceramic tube wall to provide a cured ceramic tube wall; and metallizing each end and said trough in at least one end of said ring-shaped cured ceramic tube wall for electrical connection to said high voltage tube device.

2. A method as set forth in claim 1 wherein said highly polished preshaped positive is made of brass and said step of removing said preshaped positive from said plastic mold is by slipping the mold off the positive.

3. A method as set forth in claim 2 wherein said step of compacting with ultrasonic agitation is by mounting said plastic mold with said ceramic particle slurry therein on a platform and moving said platform by ultrasonic agitation.

4. A method as set forth in claim 3 wherein said step of prebaking is at 300° C. to 500° C. for a period of 4–5 hours.

5. A method as set forth in claim 4 wherein said step of high temperature firing is at 1600° C. to 1800° C. for 15 hours.

6. A method as set forth in claim 5 wherein said plastic material in said step of setting plastic on said highly polished preshaped positive for fabricating an ultrasmooth walled plastic mold is made of a vinyl polymer type thermoplastic with a surface smoothness on the order of molecular dimensions of 0.005 to 0.01 micrometers.

7. A method as set forth in claim 6 wherein the step of removing said plastic mold from said ring-shaped green ceramic tube wall is by peeling off the plastic mold that has lost its resiliency in said prebaking step.

* * * * *